United States Patent [19]

Alack

[11] 4,054,161

[45] Oct. 18, 1977

[54] APPARATUS FOR FILLING A CONTAINER AND METHOD OF DE-AERATING MATERIAL

[75] Inventor: Charles S. Alack, St. Louis, Mo.

[73] Assignee: Semi-Bulk Systems, Inc., St. Louis, Mo.

[21] Appl. No.: 679,216

[22] Filed: Apr. 22, 1976

[51] Int. Cl.[2] ..... B65B 1/04

[52] U.S. Cl. ..... 141/12; 141/93; 141/287; 141/312; 141/316; 220/240

[58] Field of Search ..... 141/12, 59, 93, 287, 141/10, 4–8, 114, 313–317, 312, 390; 220/213, 252, 240, 287

[56] References Cited

U.S. PATENT DOCUMENTS

| | | | |
|---|---|---|---|
| 2,531,743 | 11/1950 | Ray | 141/59 |
| 2,815,621 | 10/1957 | Carter | 141/59 |
| 2,954,203 | 9/1960 | Carter | 141/59 |
| 3,689,047 | 9/1972 | Grosko | 141/287 |
| 3,777,775 | 12/1973 | Handleman | 141/59 |
| Re. 23,504 | 5/1952 | Carter | 141/59 |

*Primary Examiner*—Houston S. Bell, Jr.
*Attorney, Agent, or Firm*—Koenig, Senniger, Powers and Leavitt

[57] ABSTRACT

Apparatus for filling an open-mouth container with fluent material, such as powdered, granular or liquid material, and for removing dust or vapor from within the container during filling, the apparatus comprising a delivery head adapted to be substantially centered with respect to the container above the container for delivery of the fluent material and for removal of dust and vapor from within the container during filling, a closure carried by the delivery head expandable from a collapsed position in which it is drawn up around the delivery head and an expanded position in which it sealingly engages the inside of the container adjacent the mouth of the container to close off the mouth of the container thereby to prevent escape of dust or vapor during filling, and an actuator carried by the delivery means for expanding and collapsing said closure.

Also disclosed is a method of de-aerating powdered material filling a container.

23 Claims, 5 Drawing Figures

APPARATUS FOR FILLING A CONTAINER AND METHOD OF DE-AERATING MATERIAL

BACKGROUND OF THE INVENTION

This invention relates to filling apparatus, and more particularly to such apparatus for filling large, open-mouth containers, such as bags, rigid drums or the like with a fluent or pourable material (e.g., a dry powder, particulate material, or a liquid), for collecting dust or vapor from within the container during filling, and for preventing splashing of the material during filling.

In filling large containers, such as shown in U.S. Pat. No. 3,777,775, with bulk quantities of powdered chemicals or other materials, it is often necessary to collect dust formed during the filling operation within the container in order to protect personnel and the environment. Heretofore, in filling large flexible bags, one known dust collection system was used in which workmen pulled the bag erect up over a form and secured a rigid hood to the form. The powdered material was delivered into the bag via a fill-tube through the hood. An opening in the hood was connected to a suction-type dust collector which drew the dust from within the container and collected it. This system, however, required several workmen to secure the bag and the hood to the form. In filling some bags, it is sometimes desirable to weigh the material delivered to the bag by supporting the bag on a scale and weighing the bag as it is filled. This prior art dust collection system, however, often interfered with weighing the product delivered to the bag during the filling operation. Also, the rigid hood could not be readily adjusted to accommodate bags of different cross-section.

In filling bags or other containers with powdered material containing substantial quantities of entrained or adsorbed gases including air, such as barite used for oil-well drilling mud or the like, it is often desirable to de-aerate the powder once it is in the container thereby to reduce the volume of the material and to prevent sloshing or shifting of the powder in the container.

In U.S. Pat. Nos. Re. 23,504, 2,531,743, 2,815,621 and 2,954,203, various apparatus are disclosed for vacuum filling a container with powdered material.

SUMMARY OF THE INVENTION

Among the several objects and features of this invention may be noted the provision of a filling apparatus for filling large open-mouth containers with fluent material (e.g., powdered, particulate, granular or liquid material) and for collecting dust, fumes or vapor from within the container in which the filling apparatus may be readily secured to the container to close the container mouth, and readily removed therefrom; the provision of such filling apparatus which insures that dust, fumes or vapor from within the container is collected and is prevented from escaping into the atmosphere; the provision of such filling apparatus which may readily be adjusted to accommodate containers of various heights and cross-section; the provision of such a filling system which supports a plastic film bag or liner erect while being filled with said material; the provision of such a filling system which does not substantially effect weighing of the product delivered to the container during filling; the provision of such a filling system which enables high production rates with a minimum number of workmen; the provision of such a filling system which at least partially de-aerates powdered material delivered to the container for compaction of the powdered material; the provision of a method of filling a container with powdered material and of de-aerating the material in the container; and the provision of such filling apparatus which is of relatively simple and rugged construction and which may be readily operated by workmen with little or no special training.

Briefly, apparatus of this invention for filling an open-mouth container with fluent material, such as powdered, granular or liquid material, and for removing dust or vapor from within the container during filling, comprises means adapted to be substantially centered with respect to the container above the container for delivery of the fluent material for removal of dust and vapor from within the container during filling, a closure carried by the delivery means expandable from a collapsed position in which it is drawn up around the delivery means and an expanded position in which it sealingly engages the inside of the container adjacent the mouth of the container to close off the mouth of the container thereby to prevent the escape of dust or vapor during filling, and means carried by the delivery means for expanding and collapsing the closure.

The method of this invention for de-aerating a powdered or particulate material filling a container, the latter having a base including a generally horizontal floor for supporting the material within the container, a porous diaphragm overlying the floor and separating said material from the floor, and a passage in the container in communication with the exterior of the container and the space between the bottom face of the diaphragm and the floor, comprising filling the container with powdered or particulate material and connecting a vacuum source to the passage for reducing the pressure in the space between the diaphragm and the floor below atmosheric pressure thereby to draw air out of the material through the diaphragm to de-aerate the material and at least partially to reduce its volume. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
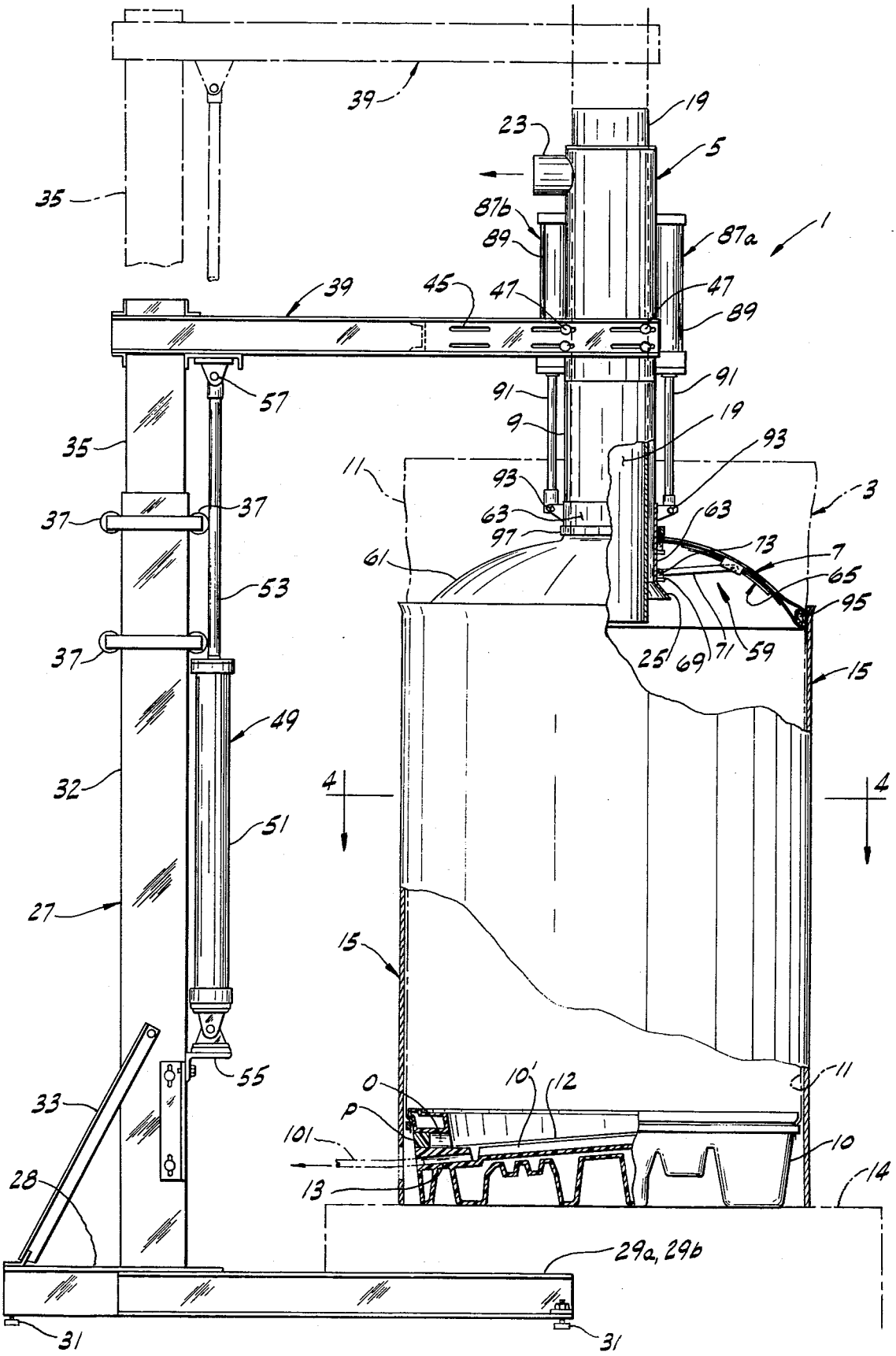
FIG. 1 is a side elevational view of filling apparatus of the present invention with parts broken away.

Referring now to the drawings, apparatus of this invention, indicated in its entirety at 1, for filling an open-mouth container 3 with pourable or fluent material (e.g., a powdered, granular, particulate, or liquid material) and for removing dust, fumes or vapor from within the container during filling, is shown to comprise a product delivery head 5 and adapted to be substantially centered with respect to the container above the container for delivery of the fluent material into the container. The delivery head carries a collapsible closure assembly 7 expandable from a collapsed position (shown in phantom in FIG. 3) in which it is drawn up around the delivery head to an extended or expanded position (shown in solid lines in FIGS. 1–3) in which it sealingly engages the inside of the container adjacent the mount of the container and closes off the mouth of the container to prevent the escpe of dust or fumes and to prevent splashing of the pourable material out of the container during filling. A dust collection duct 9 is included in the delivery head and is in communication with the interior of the container when the collapsible cover assembly is in expanded position closing off the mouth of the continer. This duct is also in communication with a suction or vacuum source (not shown), such as a vacuum-type dust collector for removing air along with dust, noxious gases or vapor from within the container.

Container 3 may be any type of open-mouth container, such as a flexible-wall bag a rigid drum, or a box. The container shown in the drawings is particularly adapated for bulk transport and storage of dry powdered or particulate chemicals or other materials and for fluidized discharge of the material from within the container. More particularly, this container is commercially available from Semi-Bulk Systems, Inc., of St. Louis, Missouri, under the trade designation "Air Pallet" and it comprises a rigid circular pallet base 10 approximately 3.5 ft (1.07 m) in diameter adapted for fork-lift transport. The base includes an upwardly facing, generally horizontal but gently sloping floor 10′ for supporting the material within the container 3. An open-mouth bag 11 constituted by a tube having its lower end secured to the pallet, the walls of the bag extending vertically upward a substantial distance (e.g., 4 to 6 ft, or 1.3 to 1.8 m). The bag may contain 40 or more cubic feet and may hold 4000 lbs. or more of fluent material. The bag is preferably of highstrength plastic film and may be optionally reinforced by circumferential straps (not shown). The walls of the bag extend above the maximum fill level of the product within the bag, so it may be supported during filling and so that after filling, the bag may be closed by twisting the mouth of the bag and tying it closed thereby to provide a weather-tight bulk storage and shipping container.

The container further has a porous diaphragm 12 (e.g., cloth) overlying the upper face of floor 10′. A passage 13 in the container (i.e., in the base) provides communication between the space between the base and the diaphragm and the atmosphere. For fluidized delivery of the powdered or particulate material in the bag 11, an air pressure line (not shown) is connected to passage 13 so as to enable air pressure to be introduced into the space between the base and the diaphragm. The latter acts as a sieve or diffuser and it permits the air to pass therethrough as many small streams into the material to fluidize it and yet prevents the material from passing through the diaphragm. Another passage O through the container serves as an outlet for the fluidized material during unloading of the container. This outlet passage O is normally closed by a plug P (see FIG. 1).

Figure 2:
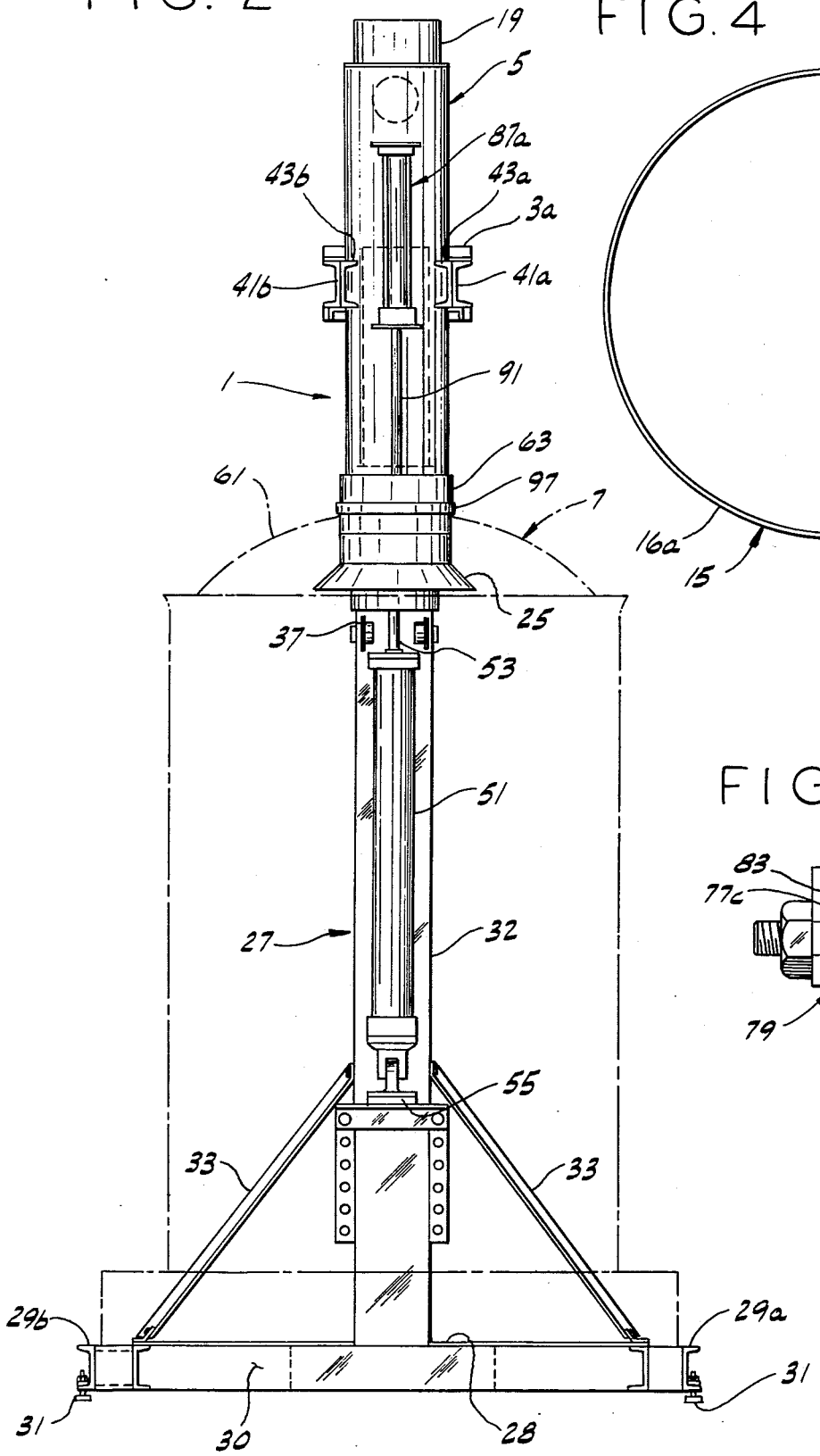
FIG. 2 is a front elevational view of FIG. 1.
Figure 4:
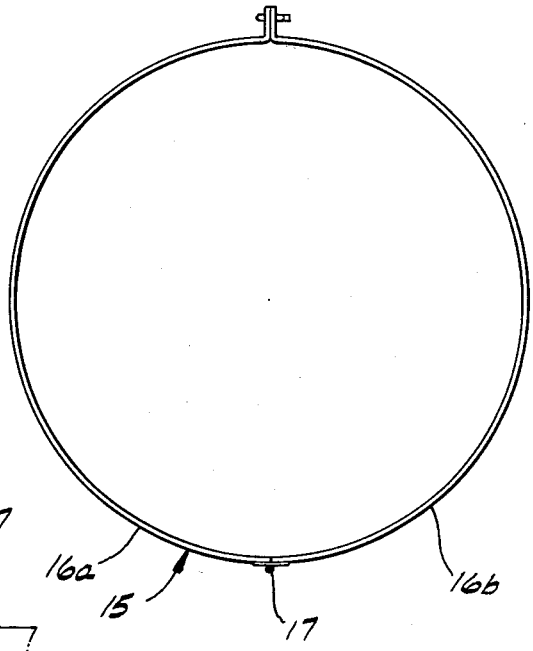
FIG. 4 is a cross-sectional view taken on line 4—4 of FIG. 1.

As shown in FIGS. 1 and 2, pallet 10 may be positioned below delivery head 5 on a scale 14 for weighing the product delivered to the bag. A removable clamshell-type form 15 (see FIG. 4) is installed around the outside of the pallet and bag. This form has two substantially identical, rigid, semi-circular wall sections 16*a*, 16*b* hingedly secured together by vertical hinges 17 for closing around the outside of the bag. The edges of the form opposite hinges 17 may be suitably releasably secured together. The upper margin of bag 11 extends above form 15 as best shown in FIGS. 1 and 2. This form thus serves to hold the bag in its desired shape and, in conjunction with the closure assembly 7 holds the bag erect as it is filled. It will be understood, however, that this form is not required when filling rigid containers, such as fiberboard drums, boxes, and the like.

Figure 3:
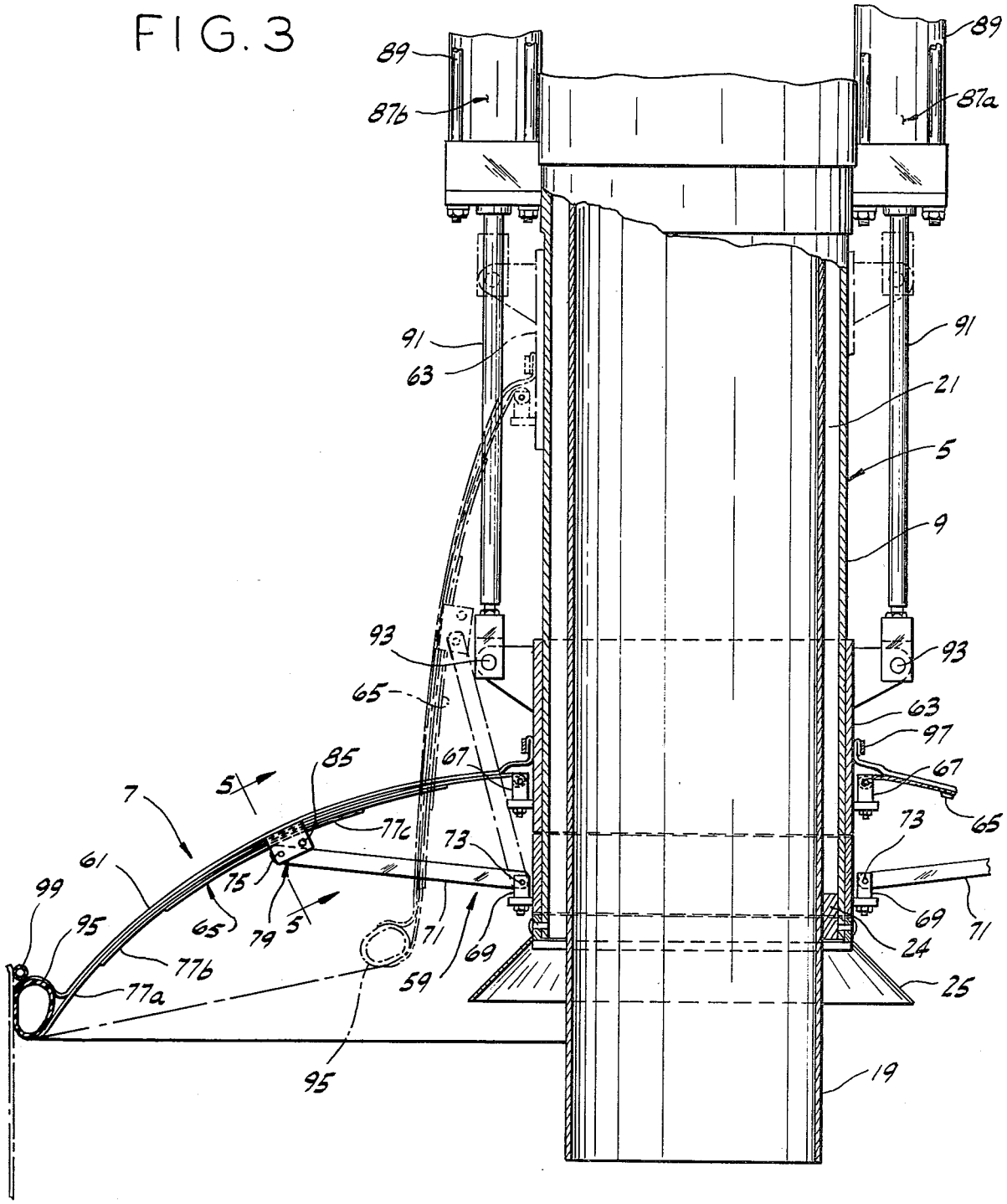
FIG. 3 is an enlarged vertical cross-sectional view of a portion of a delivery head of the apparatus showing a collapsible closure in its extended position in solid lines and in its collapsed position in phantom.

Delivery head 5 is shown to comprise a generally vertically disposed fill tube 19 connected to a product supply (not shown) for delivery of the pourable material into the container. The product supply may be an overhead hopper into which a measured charge of product is dumped for delivery into the container, or the product supply may be a conveyor, pneumatic delivery system or the like which continuously delivers product into the fill tube. Any suitable damper, slide valve, etc. or other control may be used to regulate the flow of product into the fill tube. Duct 9 surrounds a portion of the fill tube and defines an annular passage 21 between the fill tube and the duct. The upper end of this annular passage is sealed relative to the fill tube and the duct, and the lower end of this passage is open (as shown in FIG. 3). A suction inlet 23 is provided at the upper end of the duct for connection to the above-mentioned vacuum-type dust collector. The lower end of the duct extends below closure assembly 7 when the latter is in its extended position and thus constitutes an inlet for the removal of air and dust (or vapor) from within the container during filling. It will be understood that duct 9 is generally centered with respect to fill tube 19 and is so maintained by spacers 24 (see FIG. 3). A flared skirt 25 on the lower end of the duct serves to channel the flow of air and dust from within the container into the annular passage.

Delivery head 5 is supported by a frame, as generally indicated at 27, for vertical movement between an operative position (shown in solid lines in FIG. 1) in which it is positioned for delivery of fluent material into container 3 and in which the collapsible closure assembly 7 is in position for sealingly engaging the container upon being moved from its retracted or collapsed position to its expanded position, and a raised retracted position (shown in phantom) in which the closure assembly is clear of the container and from 15 to permit removal and installation of a container. It will be understood that a bellows (not shown) may be provided at the upper end of fill tube 19 to permit vertical movement of the fill tube relative to the product supply hopper. As shown, frame 27 is floor mounted but it will be understood that the support for the delivery head may also be suspended from above.

More specifically, frame 27 comprises a base 28 having a pair of spaced legs 29*a*, 29*b* straddling scale 14 and container 3 and a crossbeam 30 adjustable to vary the spacing between the legs. Leveling screws 31 are provided on the legs so as to permit leveling of the filing apparatus. A vertical outer column 32 extends up from crossbeam 30 at the center thereof. This column is a hollow, square tubular member and is braced, as indicated at 33. An inner column 35 is telescopically received in column 32 for vertical movement relative to the outer column and the base. Column 32 carries a series of vertically spaced rollers 37 at its upper end engaging the inner column for guiding the inner column as it is raised and lowered, the faces of column 32 toward and away from container 3 having cutouts (not shown) through which rollers 37 extend for rollingly engaging the inner column so as to constrain the inner column against undue movement in a vertical plane toward and away from the container.

An arm 39 is cantilevered from the upper end of inner column 35 above the container for carrying delivery head 5. As is shown in FIG. 2, arm 39 comprises a pair of spaced channels 41*a*,41*b* disposed with their webs vertical and with their flat sides facing inwardly. Duct 9 has a pair of mounting members 43*a*,43*b* on opposite sides thereof for mating with the flat faces of the webs of their respective channels 41*a*,41*b*. The webs of these channels are slotted, as indicated at 45 (see FIG. 1), for receiving mounting bolts 47 and for permitting adjustment of delivery head 5 toward and away from column 35 so that it may be positioned above the desired location of the center of container 3.

Delivery head 5 is movable between its operative and retracted positions by power-operated means, such as a fluid cylinder unit, generally indicated at 49 (e.g., an air cylinder unit), interposed between base 28 and arm assembly 39. This air cylinder has a cylinder housing 51 and a piston rod 53 movable axially inwardly and outwardly of the cylinder housing upon pressurization of the cylinder housing with a pressurized fluid (e.g., compressed air). The lower end of the cylinder housing is pivotally secured to column 32 by a bracket 55 and the outer end of the piston rod is pinned, as indicated at 57, to arm assembly 39. Bracket 55 may be selectively bolted to column 32 at any one of a plurality of fixed positions along the height of the column to vary the height of delivery head 5 when it is in its operative position so as to enable the apparatus of this invention to accommodate containers of various heights.

In FIG. 3, closure assembly 7 is shown to comprise a collapsible linkage assembly 59 (also referred to as an umbrella linkage) and a flexible cover 61 of of close-woven (or knit) textile material or the like (which may be a rubberized or plastic coated fabric) overlying and supported by the umbrella linkage for closing off the mouth of container 3 and for preventing the escape of dust or vapors or splashing of material out of the container during filling when the closure is in its expanded position. The umbrella linkage assembly comprises a collar 63 surrounding duct 9 and slidable therealong, this collar constituting a first or movable support. The linkage further includes a plurality of arms 65 (e.g., eight arms) spaced at equal angular intervals around collar 63. Each of these arms has its inner end ivotally secured to the collar, as indicated at 67, and extends generally radially outwardly from the collar when the linkage assembly is in its extended position. A plurality of pivot lugs 69, one for each arm 65, is carried by duct 9. Each of these lugs is spaced directly below its respective pivot connection 67 and these pivot lugs constitute a second or stationary support for the linkage assembly. The linkage assembly further includes a plurality of links 71, one for each arm 65, pivotally connected at one end as indicated at 73 to a respective lug 69, and pivotally connected at its other end by a pin 75 to its respective arm 65 intermediate the ends of the arm.

Figure 5:
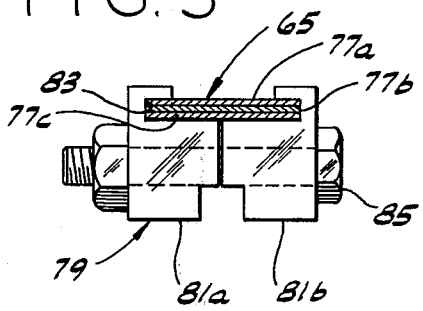
FIG. 5 is an enlarged cross-sectional view taken on line 5—5 of FIG. 3.

Each arm 65 is preferably made of a relatively stiff, resilient material, such as spring steel or the like, and more particularly each arm is of leaf-spring construction having a main leaf 77*a* extending the full length of the arm and shorter leaves, as indicated at 77*b*, 77*c*, on the inner face of the main leaf intermediate the ends of the main leaf so as to stiffen the latter. The leaves are held together by a clamp block 79 having right and left-hand sections 81*a*, 81*b* (see FIG. 5). Each of these sections has a groove 83 in its inner face for receiving the edge portions of spring leaves 79*a* -79*c*. A clamp bolt 85 clamps sections 81*a*, 81*b* together and securely holds them in adjusted position on arm 65. Clamp block 79 has another hole therethrough for reception of pin 75 for pivotal securement of link 71 thereto.

As previously mentioned, collar 63 is slidable along duct 9 toward and away from lugs 69 for effecting movement of umbrella linkage 59 between its extended and collapsed positions. More particularly, collar 63 has a substantially air-tight, slidable fit on duct 9 and is movable from a lower position (as shown in solid lines in FIG. 3) in which it is relatively close to lugs 69 and in which linkage 59 is in its expanded position to its raised position (shown in phantom) in which it is distal from lugs 69 and in which the linkage is in its retracted position. Collar 63 is moved between its lowered and raised positions by a pair of fluid cylinder units 87*a*,87*b* (also referred to as actuators) on opposite sides of duct 9. Preferably these cylinder units are operated by compressed air and each has a cylinder body 89 secured to duct 9 and a position rod 91 movable in and out of its cylinder body in axial direction with respect to the duct, the free ends of the piston rods being pivotally secured to collar 63, as indicted at 93.

As indicated at 95, a circular (as viewed from above) continuous, resilient seal is carried by the outer ends of arms 65 for sealingly engaging container 3. Preferably, seal 95 is an inflatable tube which when pressurized with compressed air becomes substantially rigid to sealingly engage the container between the outer ends of arms 65. The outer edge of cover 61 is sealingly secured to this seal (for example, a pocket may be formed in the outer margin of the cover for reception of the seal) and the inner margin of the cover is sealingly secured to collar 63 by means of an adjustable clamp 97. As heretofore described, arms 65 are resilient and are so structured that with umbrella linkage 59 in its expanded position, seal 95 engages the inside surface of bag 11 and pushes against form 15. It will be understood that as collar 63 moves to its lowered position and as arms 65 are fully extended, the outer ends of the arms and the seal engage the bag and the form before the linkage is fully extended whereby the arms are resiliently flexed so as to resiliently bias the seal outwardly. For example, each spring 65 may exert approximately a 75 lb force against form 15. This insures that seal 95 seals off the open mouth of bag 11 and securely holds the bag in place on the form so as to hold the bag erect during filling. With the closure in its expanded position, seal 95 is inflated to insure that the bag is sealingly gripped between arms 65. Seal 95 may be inflated and deflated via a hose (not shown) carried by one of the arms 65 and by filling head 5 connected to a compressed air source. A pneumatically operated valve (not shown) may be operated to effect inflation and deflation of the seal via the hose.

Spring arms 65 flex independently of one another and thus may accommodate any out-of-roundness of the bag or the form or slight amounts of offset between the center of the container and the center of the delivery head. Also, by loosening clamp bolts 85 and by adjustably sliding clamp blocks 79 along spring arms 65, the geometry of linkage assembly 59 may be varied so that both the spring force exerted by arms 65 and the size of the container which the cover assembly 7 accommodates may be readily adjusted within a limited range. Of course, by changing arms 65 and cover 61 for arms and a cover of different lengths or diameter, other sizes of containers may readily be accommodated. By providing arms 65 of different lengths and varying the number and spacing of the arms, and by replacing circular seal 95 with seals of other shapes (e.g., replacing a circular seal with a square or rectangular seal when viewed from above), oval, rectangular or other polygonal-shaped drums or boxes may be closed off during filling.

In filling containers, such as are shown in the drawings, pallet 10 with bag 11 secured thereto is positioned on scale 9 below fill tube 19 with the center of the pallet being substantially aligned with the center of the fill tube. Form 15 is opened, placed around the pallet and bag, and then closed. The walls of bag 11 are pulled up over the upper edge of the form. Air cylinder 49 is then presurized to lower delivery head 5 from its raised retracted position to its lowered operative position. Air cylinders 87*a*, 87*b* are then pressurized to move collar 63 from its raised to its lowered position so as to extend linkage 59 and to bring seal 95 into engagement with the inner surface of bag 11 and to at least partially flex arms 65. If bag 13 (or if the plastic film liner in a rigid drum) is wrinkled, the bag (or liner) is then pulled upwardly to remove the wrinkles or folds. Seal 95 is then inflated to expand outwardly and to insure sealing engagement with the bag around the seal and to securely hold the bag in place on the form. Suction is then applied to inlet 23 of duct 9 and product is delivered to bag 11 via fill tube 19. During filling, air is removed from within the container along with dust or vapor and is discharged from duct 9 into the above-mentioned vacuum-type dust collection means. In addition to collecting dust, gases and vapors, by removing air and other gases or vapor from within the container via suction inlet 23, powdered product poured into the container may be at least partially de-aerated thereby to aid in compaction of the product as it fills the container. The method of de-aerating the material in the container will be more fully described hereinafter.

Upon scale 14 indicating that a desired weight of product has been delivered into the bag, feeding of the product is stopped. Seal 95 is deflated and air cylinders 87*a*, 87*b* are pressurized so as to move collar 63 to its raised position which in turn collapses umbrella linkage 59. As the umbrella linkage collapses it will be noted that the outer ends of arms 65 and seal 95 do not move substantially below their level when extended and sealingly engaging bag 11. Thus, the bag may be filled to a level just below the level of seal 95 on the bag and the product will not interfere with collapsing of the linkage. Upon collapse of the umbrella linkage, cylinder 49 is pressurized to raise the delivery head to its raised retracted position. Form 15 is then removed and the upper portion of bag 11 is then twisted shut and tied closed. The filled container is then removed from scale 14 by a forklift truck. Thus, the apparatus of this invention is readied to begin the next filling operation.

To further aid in gripping bag 11 and for holding it erect, form 15 may have an optional, inwardly directed bead 99 around its upper edge. This bead is positioned so as to pinch the bag between the bead and the upper surface of seal 95 (see FIG. 3).

In filling containers with certain materials which do not generate dust or vapor, it may not be necessary to use the above-mentioned vacuum-type dust collector. It may nevertheless be desirable to close the open mouth of the container by cover assembly 7 so as to prevent splashing of the material out of the container during filling. In filling bags where it is not necessary to close the mouth of the bag during filling, an umbrella linkage arrangement similar to linkage assembly 59 without cover 61 may be useful for holding the bag erect.

In accordance with the apparatus and method of this invention, air may be removed from powdered or particulate material filling container 3 to compact the material and reduce its volume (thus reducing the size of the container if it is a flexible bag) and to make the filled bag stable and not subject to sloshing during shipping. In handling certain powdered or particulate materials, especially when these materials are highly aerated prior to delivery to the container, significant amounts of air may become mixed with the material, thus decreasing the density and the stability of the powder. As previously mentioned, the material can be at least partially de-aerated by the removal of dust and air from within the container via duct 21 and the vacuum dust collector connected to vacuum inlet port 23. Further in accordance with the method and apparatus of this invention, the material may be de-aerated by attaching a vacuum hose 101 to compressed air passage 13 of base 10 thereby to draw a partial vacuum (i.e., reduce air pressure below atmospheric presure) in the space between base 10 and porous diaphragm 12. Thus, air mixed with the material in the container will be positively drawn out by the vacuum thereby to compact the powdered material and to increase both its density and stability. This vacuum may be drawn while the material is being delivered into the container so that the material is de-aerated while the container is being filled. It will be understood that diaphragm 12 permits the vacuum to draw air out of the material and yet prevents powder from passing therethrough. While the above-mentioned vacuum de-aerating method is preferred, at least some de-aeration of powdered material can be realized by opening the product outlet passage O of the container thereby to permit air to be exhausted while the container is being filled.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for filling an open-mouth container with fluent material, such as powdered, granular or liquid material, and for removing dust or vapor from within the container during filling, said apparatus comprising means adapted to be substantially centered with respect to the container above the container for delivery of the fluent material and for removal of dust and vapor from within the container during filling, a closure carried by the delivery means extendable from a retracted position in which it is drawn up around the delivery means and an extended position in which it sealingly engages the inside of the container adjacent the mouth of the container to close off the mouth of the container thereby to prevent the escape of dust or vapor during filling, and means carried by the delivery means for extending and retracting said closure.

2. Apparatus as set forth in claim 1 further comprising means for moving said delivery means between an operative position in which it is positioned for the delivery of said fluent material into said container and in which said closure is in position for being extended to sealingly engage said container and a retracted position in which said delivering means is clear of said container.

3. Apparatus as set forth in claim 1 wherein said delivery means comprises a generally vertically disposed fill tube, and a duct surrounding at least a portion of said fill tube with the lower end of the duct being in communication with said container when said closure is in its extended position and with the upper end of the duct closed, said duct having means for connection to a suction source for removal of dust and vapor from within said container during filling.

4. Apparatus as set forth in claim 1 wherein said closure further comprises a cover of flexible material, and wherein said means for extending and retracting said closure comprises a linkage carried by said delivery means, said cover being secured to said linkage for movement therewith, and actuating means for moving said linkage and said cover between said retracted position of said closure in which said linkage and said cover are folded in on said delivery means and said extended position of said closure in which said linkage and said cover are expanded out from said delivery means and said cover closes off the mouth of said container.

5. Apparatus as set forth in claim 4 wherein said linkage comprises a first support on said delivery means, a plurality of arms having their inner ends pivotally secured to said first support and extending generally radially outwardly from said delivery means when said linkage is in its extended position, a second support carried by said delivery means, and a plurality of links, one for each said arm, each said link being pivotally connected at one end to said second support and at its other end to a respective said arm intermediate the ends of the arm, said first and second support being movable relative to one another for effecting movement of said linkage means between its retracted and extended positions.

6. Apparatus as set forth in claim 5 wherein said first support is a collar slidable axially on said delivery means, and wherein said second support is fixed relative to said first support.

7. Apparatus as set forth in claim 5 wherein said closure further comprises a seal member carried by said outer end of said arms for sealing engagement with said container, said seal member being continuous around said closure and having said cover sealingly secured thereto.

8. Apparatus as set forth in claim 7 wherein the upper end of said cover is sealingly secured to said collar.

9. Apparatus as set forth in claim 6 wherein said actuating means comprises at least one fluid cylinder unit interconnected between said collar and said delivery means.

10. Apparatus as set forth in claim 7 wherein said arms are of resilient material so that upon movement of the arms to their extended position and upon engagement with said container they resiliently bias said seal member into sealing engagement with said container.

11. Apparatus as set forth in claim 7 wherein said seal member is an inflatable seal.

12. Apparatus as set forth in claim 6 wherein said arms and said links are so structured that upon movement of said collar to effect movement of said arms from their extended to their retracted position, the outer ends of the arms move upwardly relative to the level at which they engage said container when in their extended position whereby said container may be filled to said level without said material in said container interfering with said arms as they are retracted.

13. Apparatus as set forth in claim 2 wherein said means for moving the delivery means between its operative and retracted positions comprises a base, a member telescopically received by the base for movement in vertical direction, an arm cantilevered from said telescoping member, said arm carrying said delivery means, and power-operated means for moving said member and said delivery means between said operative and retracted positions.

14. Apparatus as set forth in claim 1 wherein said container is a flexible open-mouth bag extending up above the level of said closure when in its expanded position, said apparatus further comprising a rigid form adapted to fit around the outside of the bag for providing an abutment for said bag so as to enable said closure to sealingly engage said bag and to hold the bag erect during filling when the closure is in its extended position.

15. Apparatus as set forth in claim 14 wherein said bag is of generally circular cross section and wherein said form has at least two portions part circular in cross section each extending heightwise of the bag and circumferentially around the bag, said portions being hingedly secured together along a generally vertical hinge line and being releasably securable along another generally vertical line whereby said form may be swung open and closed for installation around said bag and for removal therefrom.

16. Apparatus as set forth in claim 1 further comprising means for de-aerating said material after it has been delivered into said container.

17. Apparatus as set forth in claim 16 wherein said container has a floor for supporting the material loaded therein, a porous member overlying said floor permitting air to pass therethrough but preventing the passage of said material, and a space between the bottom face of said diaphragm and said floor, said de-aerating means comprising means for connecting a vacuum source to said passage for reducing the pressure in said space thereby to draw air out of said material filling said container.

18. Apparatus for filling an open-mouth container with fluent material, such as powdered, granular or liquid material, and for removing dust or vapor from within the container during filling, said apparatus comprising means for delivery of said material into the container from the top of the container, a collapsible closure adapted in its retracted state to be entered in the mouth of the container and then extended into sealing engagement with the inside of the container adjacent the mouth end of the container to close off the mouth of the container to prevent the escape of dust or vapor during filling of the container, said collapsible closure including a linkage carried by said delivery means actuable for moving said closure between its retracted and extended positions, said apparatus further comprising a duct for communication with the inside of the container during filling and with a suction source for removing dust or vapor from within the container.

19. Apparatus for filling a flexible container, such as a bag, with fluent material, such as a powdered, granular, or liquid material, and for holding the bag erect during filling thereof, said apparatus comprising means adapted to be substantially centered with respect to the bag above the bag for delivery of fluent material into the bag, a rigid, removable form around the outside of the bag, collapsible linkage means carried by said delivery means for movement between a retracted position in which the linkage is folded up on said delivery means and an extended position which said linkage engages the inside of said bag adjacent the mouth of the bag for pushing the bag outwardly for clamping it to said form thereby to hold the bag erect as it is filled, and actuating means for said linkage.

20. Apparatus as set forth in claim 19 further comprising a cover carried by said linkage for closing off the mouth of said bag when said linkage is expanded so as to prevent the escape of dust or vapor from the bag during filling.

21. Apparatus as set forth in claim 20 wherein said delivery means includes a duct in communication with the interior of said bag when said linkage and said cover are in their extended state and with a suction source to remove dust and vapors from within the bag during filling.

22. A method of de-aerating a powdered or particulate material filling a container, the latter having side walls, a base including a generally horizontal floor for supporting a load of said material in said container, a porous diaphragm overlying said floor separating the material from the floor, and a passage in the container in communication with the exterior of the container and the space between the bottom face of said diaphragm and said floor, said method comprising filling the container with powdered or particulate material and connecting a vacuum source to said passage for reducing the pressure in said space below atmospheric pressure thereby to draw air out of said material through said diaphragm to de-aerate said material and to at least partially reduce its volume.

23. The method of claim 22 wherein said passage is connected to said vacuum source and said pressure is reduced while said container is being filled.

* * * * *